US009363860B1

(12) United States Patent
Lowchareonkul

(10) Patent No.: US 9,363,860 B1
(45) Date of Patent: Jun. 7, 2016

(54) INTELLIGENT LIGHT SOURCE

(71) Applicant: Phahol Lowchareonkul, Los Altos Hills, CA (US)

(72) Inventor: Phahol Lowchareonkul, Los Altos Hills, CA (US)

( * ) Notice: Subject to any disclaimer, the term of this patent is extended or adjusted under 35 U.S.C. 154(b) by 247 days.

(21) Appl. No.: 14/089,007

(22) Filed: Nov. 25, 2013

(51) Int. Cl.
*H01J 1/60* (2006.01)
*H01J 7/42* (2006.01)
*H05B 37/04* (2006.01)
*H05B 37/00* (2006.01)

(52) U.S. Cl.
CPC ..... *H05B 37/00* (2013.01)

(58) Field of Classification Search
USPC ..... 315/129–136
See application file for complete search history.

(56) References Cited

U.S. PATENT DOCUMENTS 5,462,439 A * 10/1995 Keith ..... B60L 1/08 180/279
6,169,387 B1 * 1/2001 Kaib ..... A61N 1/3931 320/132
8,538,625 B1 * 9/2013 Lowchareonkul ..... B60K 35/00 340/425.5
8,562,169 B2 * 10/2013 Kempter ..... H05B 33/0803 362/171
2007/0120058 A1 * 5/2007 Blackwell ..... G01J 5/061 250/338.1
2007/0197889 A1 * 8/2007 Brister ..... A61B 5/1411 600/347
2009/0177068 A1 * 7/2009 Stivoric ..... A61B 5/01 600/365
2010/0084997 A1 * 4/2010 Oberzeir ..... F21L 4/027 315/313
2010/0176750 A1 * 7/2010 West ..... F21L 4/027 315/362
2012/0206050 A1 * 8/2012 Spero ..... B60Q 1/04 315/152
2013/0134891 A1 * 5/2013 Woytowitz ..... H05B 37/02 315/201
2013/0141010 A1 * 6/2013 Reed ..... H05B 37/02 315/294
2014/0062297 A1 * 3/2014 Bora ..... H05B 33/0845 315/34
2014/0327991 A1 * 11/2014 Chung ..... H02H 5/083 361/18

* cited by examiner

*Primary Examiner* — Brandon S Cole
(74) *Attorney, Agent, or Firm* — R&D Patent Attorneys

(57) ABSTRACT

Intelligent light source and methods to make various types of an intelligent light source for the benefit of a user. One embodiment is a method of making an intelligent light source. A second embodiment is an intelligent light source that has a data processor. A third embodiment is an intelligent light source that has a display. Various embodiments having a display can display one or more parameters.

20 Claims, 16 Drawing Sheets

INTELLIGENT LIGHT SOURCE

BACKGROUND OF THE INVENTION

1. Field of the Invention

This invention relates generally to the field of light sources, and more specifically to providing intelligent light sources.

2. Description of the Prior Art

Light sources (e.g., flashlights, lanterns, light fixtures (both portable and fixed), and equivalents) have been known and used for many years, but such light sources have been limited in their usefulness.

One problem with prior art light sources is that they require mechanical movements by a user to focus a light beam (e.g., the user must move or twist something on the prior art light source to change it from producing a narrow beam to producing a wide beam or vice versa) or to change the light source from a lantern into a flashlight or vice versa. Another problem with the prior art light sources is that they do not indicate when their battery will run out. Prior art light sources are unintelligent and do not give the user valuable information about the battery of the light source or estimate the operational time remaining

SUMMARY OF THE INVENTION

The present invention provides methods to manufacture an intelligent light source and implementations of intelligent light sources. Embodiments of the invention can be implemented in numerous ways. Three aspects of the invention are described below.

A first aspect of the invention is directed to a method to make an intelligent light source. The method includes fabricating one or more substrates, wherein the one or more substrates can support one or more lights and a data processor; coupling one or more batteries to the one or more substrates; coupling a current detection circuit on the one or more substrates to the one or more batteries; coupling a data processor and one or more analog to digital converters to the current detection circuit; installing one or more buttons in proximity to the data processor, and coupling the data processor to the one or more buttons; and placing the one or more substrates inside an intelligent light source body and head to assemble a complete unit.

A second aspect of the invention is directed to an intelligent light source. The intelligent light source includes one or more substrates; one or more batteries coupled to the one or more substrates; a current detection circuit coupled to the one or more batteries;

a data processor and one or more analog to digital converters coupled to the current detection circuit; and one or more buttons in the intelligent light source enclosure, wherein the one or more buttons are coupled to the data processor.

A third aspect of the invention is directed to a method of making an intelligent light source. The method of making an intelligent light source includes fabricating one or more substrates, wherein the one or more substrates can support one or more lights and a data processor; coupling one or more batteries to the one or more substrates; coupling a current detection circuit on the one or more substrates to the one or more batteries; coupling a data processor and one or more analog to digital converters to the current detection circuit; installing at least one display coupled to the data processor; installing one or more buttons in proximity to the display, and coupling the display to the one or more buttons; and placing the one or more substrates inside an intelligent light source body and head to assemble a complete unit.

BRIEF DESCRIPTION OF THE DRAWINGS

Non-limiting and non-exhaustive embodiments of the invention are described with reference to the following figures or drawings.

DETAILED DESCRIPTION OF THE PREFERRED EMBODIMENTS

Figure 1:
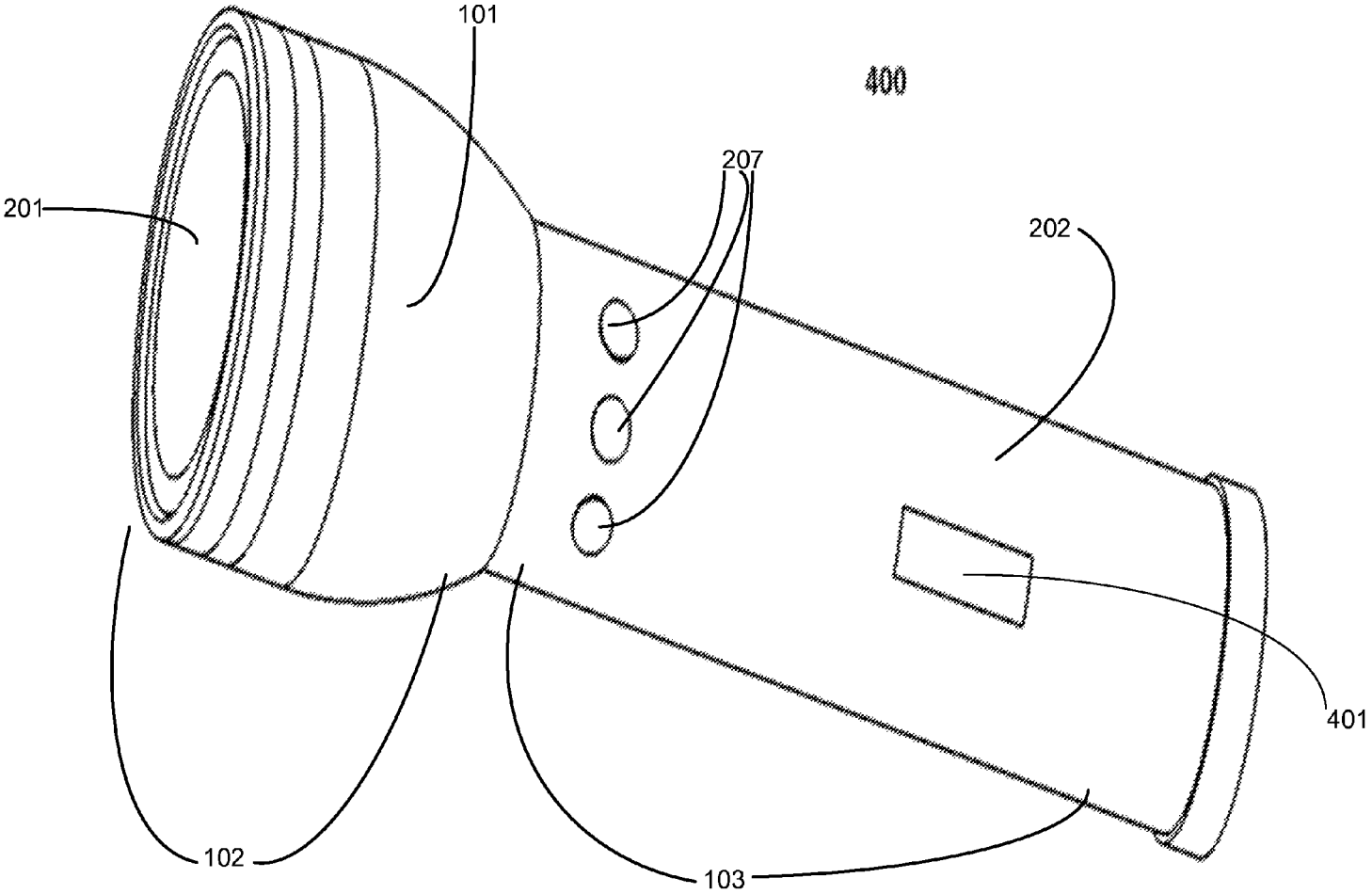
FIG. 1 illustrates a basic intelligent light source, in accordance with one embodiment of the invention.

Embodiments of the inventions can be constructed from off-the-shelf components. In all of the embodiments disclosed below, different materials could be used for the intelligent light source, including but not exclusively: various plastics, resins, papers, fabrics, plant fibers, ceramics, and metals. The metal pieces would typically be made from a metal or some metal alloy, but could alternatively be made from other resilient materials, such as plastics, and other equivalent manmade materials.

For a user, it would be helpful to know the precise amount of charge remaining in the battery of the light source, and the actual current draw (in and out) of the battery of the light source. The user would gain a much better idea of the battery status of the light source and a more precise of idea of remaining time for operation. In various embodiments, an optional display can show one or more of the following types of information.

Table 1 provides examples of information that can be shown on the optional display.

TABLE 1

| | |
|---|---|
| 100% Charge Remaining - This is calculated from the known charge in mAh remaining in the battery divided by the total battery capacity of the intelligent light source. | 4503 mAh - This shows the actual amount of charge remaining in the battery of the intelligent light source. |
| 300 mA Current Out - This shows the actual current being supplied by the battery of the intelligent light source. | 500 mA Current In - This shows the actual charge current being supplied to the battery of the intelligent light source. |
| 2.01 Watts Out - This shows the actual power being supplied to the battery of the intelligent light source. | 4.12 Watts In - This shows the actual charge power being supplied to the battery of the intelligent light source. |
| 2 h 20 min Remaining - This shows the exact time when the battery of the intelligent light source will run out. This time is derived from calculating the known amount of charge remaining, divided by the current out. | 1 h 10 min to Full - This shows the exact time left to charge the battery. This time is derived from calculating the known amount of charge when the battery of the intelligent light source is full, subtracting this with the actual amount of charge remaining and dividing by the amount of current in. |
| 50 Deg C. or F. - The battery temperature is also monitored to correct for temperature variation of the battery of the intelligent ligh source to account of shifts in measured current, voltage, capacity, etc. | 3.76 volts - Indicates the voltage of the battery of the intelligent light source. |
| 1 yr 35 Days - Indicates the age of the battery of the intelligent light source. By determining the age, it would be possible to also correct for decreased battery capacity over time, for example a decrease of about 1-5% every year. | Battery degradation in percentage or in milliampere hours (mAh). |
| An embodiment with a LCD/OLED display can also display the actual brightness in percent output as well as brightness in "Lumens." Lumens is the flashlight industry standard for light intensity. Brightness can also be displayed for each LED individually or in groups of LEDs such as (Flood, Beam, and Lantern) in both Percent output, Lumens, Current, Watts or equivalents. | An embodiment with a LCD/OLED display can display modes of operation. For example, the flashlight can be in Flood, Beam, Lantern, 50% beam 50% lantern, 33% beam, lantern, flood, etc. or any other combination. This gives the user the ability to see on the display what "Mode" the flashlight is currently operating in. Some modes can be described as Beam, Lantern, Flood, Emergency, Low light reading, or equivalents. |

Components

In various embodiments, the intelligent light source includes one or more of the following types of components. Table 2 provides a list of components for one embodiment of the invention as shown in the following figures, but alternative embodiments can have a subset of the following components or additional components.

TABLE 2

| | |
|---|---|
| Lantern Light 101 | In one embodiment this includes one or more Pulse-Width Modulated PWM or Voltage Controlled Dimmable LEDs. In one embodiment this is a wide area light. In one embodiment it may include reflectors or equivalents. |
| Head 102 and Body 103. | In one embodiment the head and body provide a plastic enclosure that has a top and bottom used to house all the electronics inside the product. |

TABLE 2-continued

| | |
|---|---|
| Digital Focus 201 | In one embodiment this adjusts the light between multiple flood light and beam states and intensities. |
| Cap Sense Body 202 | optional in various embodiments |
| Cap Sense Interface Buttons 203 | In one embodiment the buttons can be push buttons or capacitive sense touch buttons. In one embodiment the buttons can be used to toggle the views and turn on and off the intelligent light source. |
| Beam Light 205 | In one embodoiment this includes one or more Pulse-Width Modulated PWM or Voltage Controlled Dimmable LEDs |
| Flood Lights 206 | In one embodiment this includes one or more Pulse-Width Modulated PWM or Voltage Controlled Dimmable LEDs |
| Soft-Switch 207 | optional in various embodiments |
| Wireless Control 208 | optional in various embodiments |
| Intelligent Battery Meter 302 | optional in various embodiments |
| Infrared Transmitter/ Receiver 303 | optional in various embodiments |
| 1D, 2D, 3D Accelerometer 304 | optional in various embodiments |
| Passive Infrared (PIR) Motion Sensor 307 | optional in various embodiments |
| Ambient Light Sensor 308 | optional in various embodiments |
| Auditory/Physical Feedback alarm 309 | optional in various embodiments |
| One or more batteries 306. | In one embodiment this can be one or more lithium polymer batteries 3.7 V (But in alternative embodiments this can be any type of battery, e.g., lithium ion, lithium FE, nickel cadmium, nickel metal hydrate, lead acid, or any other electrochemical storage technology.) |
| Current detection circuit 114. | In one embodiment this includes a small precision resistor, one embodiment uses a 0.01-0.1 Ohm resistor. By measuring the voltage across this resistor (both positive and negative), one embodiment of the invention can precisely determine the actual amount of current that flows in and out of the battery (e.g., such as a lithium battery) of the intelligent light source. |
| Data Processor 305. | In one embodiment, it has analog to digital converters built-in to detect the voltage across the current detection circuit. In one embodiment the data processor (e.g., a microprocessor or micro-controller or equivalent) also has digital input and output ports to control the display graphics and buttons for user input. |
| Display 301. | Optional. In various embodiments, the display can be an OLED, flexible OLED, LED, LCD, dot matrix, character, or equivalent display used to show one or more parameters about the status of the light source and other info. |
| Rubber cap 501 | Optional |
| Head enclosure 502 | Optional |
| Beam focus 503 | Optional |
| Printed Circuit Board 600 | Optional |

Various embodiments of the invention can be implemented on one or more substrates. One embodiment utilizes only one substrate. One embodiment utilizes a first substrate and a second substrate. One embodiment utilizes a first substrate, a second substrate, and a third substrate.

Various embodiments of the invention can utilize LEDs that, for example, are commercially available from the following manufacturers—Cree Inc., with corporate headquarters in Durham, N.C. (e.g., the Xlamp XT-E or equivalents); Lite-On Inc., with corporate headquarters in Milpitas, Calif. (e.g., the LTPL or equivalents); Philips Lumileds, with corporate headquarters in San Jose, Calif. (e.g., the Luxeon Z or equivalents).

Various embodiments of the invention can utilize a display that is commercially available from the following manufacturers—LG Electronics Inc., with corporate headquarters in Seoul, South Korea; Samsung, with corporate headquarters in Seoul, South Korea; Lumex, with corporate headquarters in Palatine, Ill. (e.g., the LCM-x24064Gxx9(-x) or equivalents); Varitronix, with corporate headquarters in Kwun Tong, Hong Kong (e.g., the VIM-878 Series or equivalents); Kyocera Industrial Ceramics Corp., with corporate headquarters in San Diego, Calif. (e.g., the C-51505 or equivalents).

Various embodiments of the invention can utilize data processor, such as a micro-controller or microprocessor that is commercially available from the following manufacturers—Microchip Technology Inc., with corporate headquarters in Chandler, Ariz.; Cypress Semiconductor, with corporate headquarters in San Jose, Calif.; Texas Instruments, with corporate headquarters in Dallas, Tex. (e.g., the ARM9 or equivalents); Zilog, with corporate headquarters in Milpitas, Calif. (e.g., the Z180 or equivalents); and Freescale Semiconductor, with corporate headquarters in Austin, Tex. (e.g., the MPC83xx, or equivalents).

Various embodiments of the invention can utilize accelerometers that, for example, are commercially available from the following manufacturers—Bosch Sensortec, with corporate headquarters in Reutlingen, Kusterdingen, Germany (e.g., the BMA222 or equivalents); Kionix Inc., with corporate headquarters in Ithaca, N.Y. (e.g., the KXTC9 or equivalents); and Murata Electronics, with corporate headquarters in Kyoto, Japan (e.g., the SCA3060 or equivalents).

Various embodiments of the invention can utilize Infrared (IR) sensors that, for example, are commercially available from the following manufacturers—Sharp Microelectronics, with corporate headquarters in Camas, Wash. (e.g., the GP2AP002x00F or equivalents); Vishay Semiconductor Opto Division, with corporate headquarters in Malvern, Pa. (e.g., the VCNL3020 or equivalents); and OSRAM Opto Semiconductors Inc., with corporate headquarters in Munich, Germany (e.g., the SFH7743 or equivalents).

Various embodiments of the invention can utilize Passive Infrared (PIR) motion sensors that, for example, are commercially available from the following manufacturers—Panasonic Electric Works, with corporate headquarters in New Providence, N.J. (e.g., the EKMC or equivalents); Parallax Inc., with corporate headquarters in Rocklin, Calif. (e.g., the 555-28027 or equivalents); and Zilog, with corporate headquarters in Milpitas, Calif. (e.g., the ZMOTION or equivalents).

Various embodiments of the invention can utilize photoresistors that, for example, are commercially available from the following manufacturers—Advanced Photonix Inc., with corporate headquarters in Ann Arbor, Mich. (e.g., the PDV-P8103 or equivalents); and Parallax Inc., with corporate headquarters in Rocklin, Calif. (e.g., the VT900 or equivalents). Various embodiments of the invention can utilize piezo materials that, for example, are commercially available from the following manufacturers—CUI Inc., with corporate headquarters in Tualatin, Oreg. (e.g., the CEB-20D64 or equivalents); and PUI Audio Inc., with corporate headquarters in Dayton, Ohio (e.g., the AB2036B or equivalents).

Various embodiments of the invention can utilize power circuits that, for example, are commercially available from the following manufacturers—Texas Instruments Inc., with corporate headquarters in Dallas, Tex.; Linear Technology, with corporate headquarters in Milpitas, Calif.; Maxim Integrated, with corporate headquarters in San Jose, Calif.; and Microchip Technology Inc., with corporate headquarters in Chandler, Ariz. Various embodiments of the invention can utilize connectors that, for example, are commercially available from the following manufacturers—Molex Inc., with corporate headquarters in Lisle, Ill.; 3M Company, with corporate headquarters in Maplewood, Minn.; and Panasonic, with corporate headquarters in Osaka, Japan.

Various embodiments of the invention can utilize batteries that, for example, are commercially available from the following manufacturers—Dongguan Kanyo Battery Technology Co LTD., with corporate headquarters in Guangdong, China; and Unitech Battery Limited, with corporate headquarters in Shenzhen City, China.

In various embodiments of an intelligent light source shown below, a display can be implemented by liquid crystal display (LCD), organic light emitting diode (OLED) display, flexible OLED display, light emitting diode (LED) display, dot matrix display, segmented display, character display, or an equivalent display technology. In various embodiments, the display can display one or more of the following: battery charge level, estimated remaining battery life, battery degradation in percentage or in milliampere hours (mAh), clock time, and/or equivalent parameters (e.g., as shown in Table 1 above).

In various embodiments, any of the above information can be represented on the display in graphical form, graphic form, plot form, character form, numeric form, or plot form, or in any combination. In various embodiments, there is a user interface that allows the user to switch between views by toggling one or any buttons. In various embodiments, the buttons can be mechanical push buttons, switches, capacitive sense, touch screen or any equivalent type of human interface method to capture user input. In summary, various embodiments of the invention can include the following user interfaces (1) physical buttons, including soft or hard buttons, (2) capacitive sense buttons or making the shell of the flashlight a button, and (3) a touch screen interface, where the screen can be single touch or multi-touch similar to common cell phone devices.

Various embodiments of the invention can have varying sizes of batteries, capacities, and battery technology types (e.g., lithium polymer, lithium ion, lithium FE, nickel cadmium, nickel metal hydrate, lead acid, or any other electrochemical storage technology). Various embodiments of the invention can have one or more outputs to charge one or more devices. In various embodiments, the data can be displayed by connecting by wireless or wire connectivity to smartphones, tablet computers, personal computers (PCs), or equivalents. In one embodiment the data can be sent to a smart-phone app to view all the data. Various embodiments of the invention can thus use an external display instead of a display built into the product.

Various embodiments of the invention can have varying output voltages, for example 5.0 volts, 3.3 volts, etc. Various embodiments of the invention can have various output plugs (e.g., USB, FireWire and equivalents) and just not limited to USB male A. Various embodiments of the invention can have various input plugs to accommodate different formats of charging the battery of the intelligent light source. Various embodiments of the invention can have a rubber seal around the mating top and bottom of the enclosure to make the enclosure water tight, and water resistant.

Data Processor Calculations

Some embodiments of the invention can have a data processor (e.g., a microprocessor or a micro-controller or an equivalent) that will be able to determine at any given time the rate of current draw going in and out of the battery. By knowing the sampling time, (variable or fixed), various embodiments of the invention can determine how much charge or discharge in milliampere hours (mAh) the battery has charged or drained during that time. Various embodiments of the invention with a higher sampling rate will give a more accurate calculation.

FIGS. 1 through 4 illustrate the novel features of the intelligent light source in various embodiments. The intelligent light source head 102 contains the physical lantern light 101 built into the head portion of the intelligent light source. In one embodiment, the lantern light 101 also has, but is not limited to, a convex, parabolic reflector which can be made of plastic or metal with a reflective surface. This reflective surface may have a mirror-like or textured surface.

FIG. 1 illustrates a basic intelligent light source, in accordance with one embodiment of the invention. FIG. 1 shows an intelligent light source 400 comprising a lantern light 101, a head 102, a body 103, a digital focus 201 (which adjusts the light between multiple flood and beam states and intensities), a cap sense body 202, a group of three soft-switches 207, and a screen 401 over a display (not shown).

Figure 2:
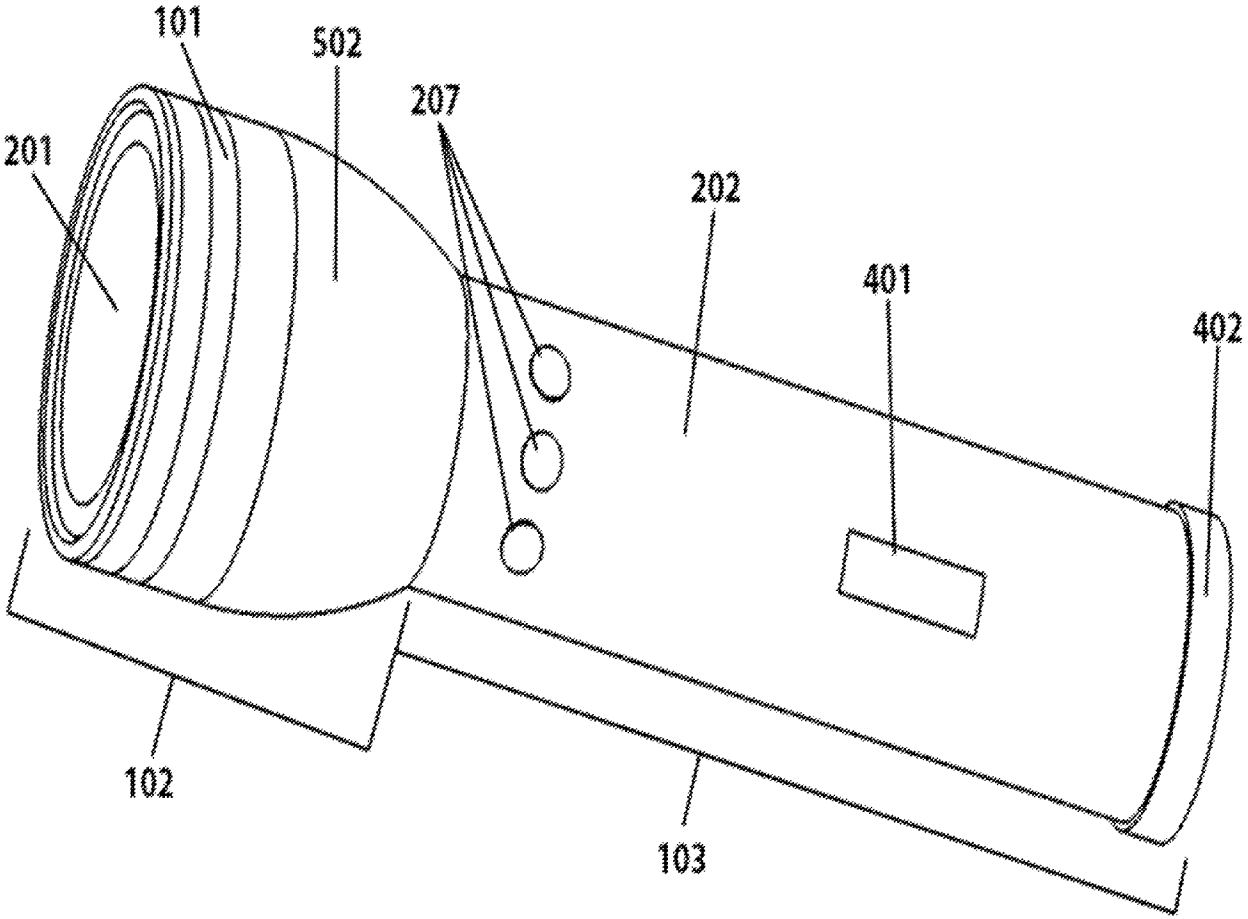
FIG. 2 illustrates an alternative intelligent light source, in accordance with one embodiment of the invention.

FIG. 2 illustrates an alternative intelligent light source, in accordance with one embodiment of the invention. FIG. 2 shows an intelligent light source comprising a lantern light 101, a head 102, a body 103, a digital focus 201 (which adjusts the light between multiple flood and beam states and intensities), a cap sense body 202, one or more cap sense interface buttons 203, a group of three soft-switches 207, a transparent or semi-transparent screen 401, an end cap 402 and a head enclosure 502.

In the embodiment of FIG. 2 there is a transparent or semi-transparent screen 401. In various embodiments, the screen can be an OLED, flexible OLED, LED, LCD, dot matrix, character, or equivalent display used to show one or more parameters about the status of the light source and other info.

Figure 3:
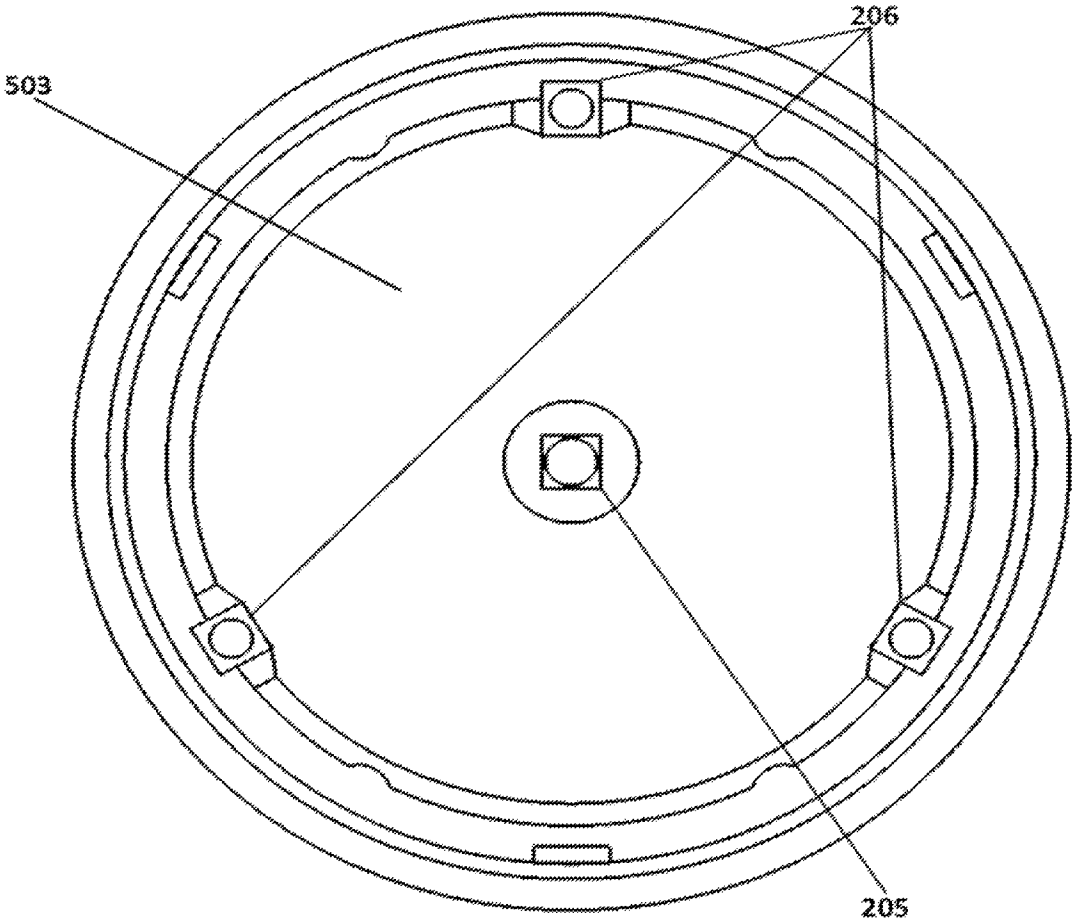
FIG. 3 illustrates an front view of an intelligent light source, in accordance with one embodiment of the invention.

FIG. 3 illustrates a front view of an intelligent light source, in accordance with one embodiment of the invention. FIG. 3 shows a beam focus 503, a beam light 205 and three flood lights 206. In another embodiment, it could be one or more flood lights 206.

In one embodiment, the beam light 205, flood light 206, and lantern light 101 use PWM or voltage controlled dimmable LEDs 204. In one embodiment, the digital focus 201 adjusts the light between multiple flood and beam states by blending the beam light 205 with the flood light 206 using pulse-width modulation or voltage control, or an equivalent control.

Figure 4:
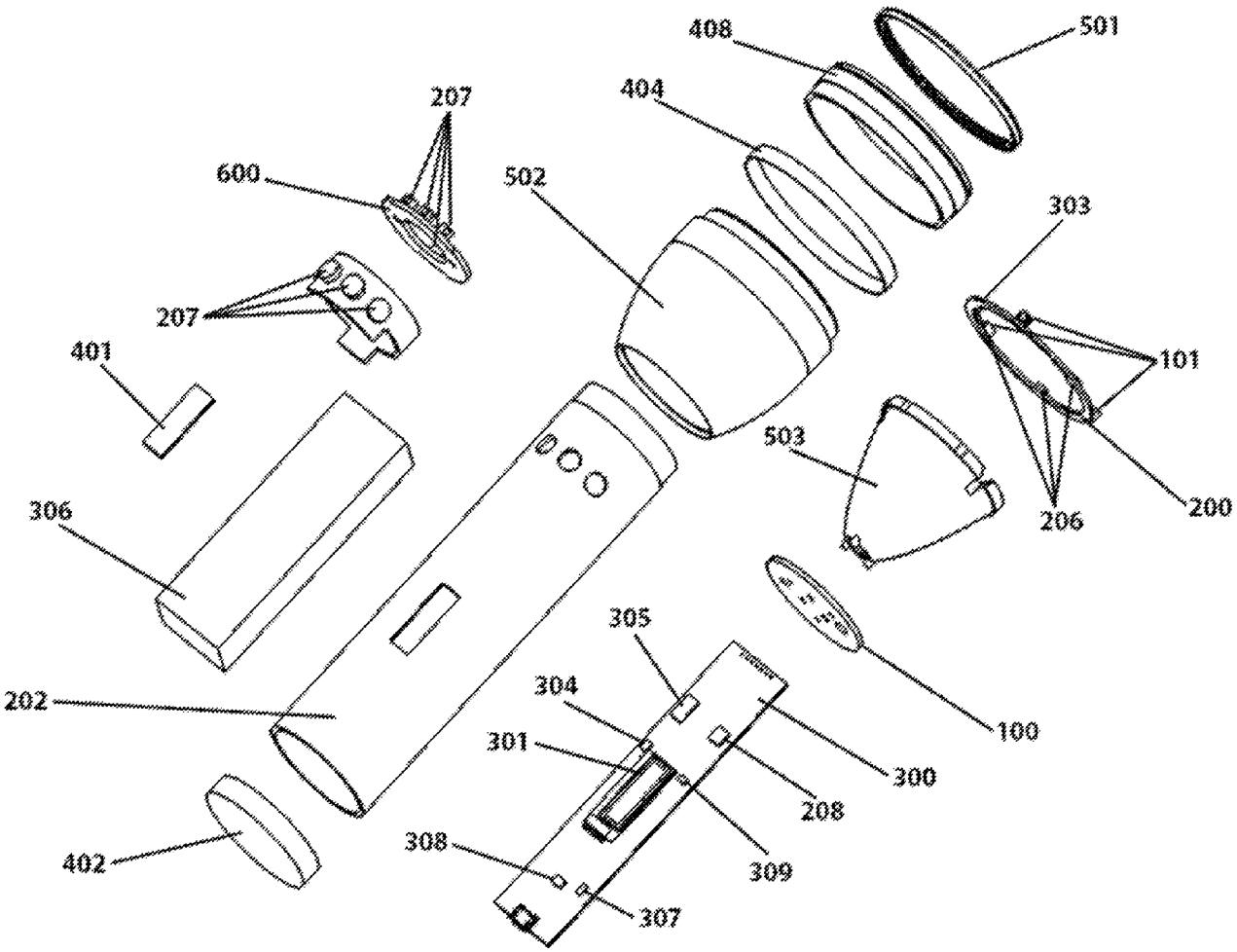
FIG. 4 illustrates an exploded isometric view of an intelligent light source, in accordance with one embodiment of the invention.

FIG. 4 illustrates an exploded isometric view of an intelligent light source, in accordance with one embodiment of the invention. FIG. 4 shows an intelligent light source comprising a first substrate 100, an optional second substrate 200, a lantern light 101, a head 102, a body 103, a digital focus 201 (which adjusts the light between multiple flood and beam states and intensities), a cap sense body 202, one or more cap sense interface buttons 203, a plurality of dimmable LEDs (where in various embodiments the LEDs are pulse-width modulated PWM LEDs, or voltage controlled LEDs, or equivalent LEDs) to implement a beam light 205 and a flood light 206, a soft-switch 207, a wireless control 208, an optional third substrate 300, a display 301, an intelligent battery meter 302, an infrared transmitter/receiver 303, a 1D, 2D, 3D accelerometer 304, a data processor 305, a battery with charger circuit 306 (e.g., a lithium polymer battery or equivalent), a passive infrared (PIR) motion sensor 307, an ambient light sensor 308, an auditory/physical feedback alarm 309. In addition, in this embodiment there are also a transparent or semi-transparent screen 401, an end cap 402, an end cap spacer 403, a decorative ring 404, a spacer 405, a heat sink 406, a lantern reflector 407, a head cap 408, a rubber cap 501, a head enclosure 502, a beam focus 503, and a printed circuit board 600.

In one embodiment, the infrared transmitter/receiver 303 is a sensor that detects the amount of light present. It's placement in embodiments of the intelligent light source allows the user to cover the area where the beam/flood light is emitted from (such as placing their hand over this area), allowing less light to be detected by the sensor. When little to no light is detected by the infrared transmitter/receiver 303, the flashlight will switch from beam/flood mode to lantern mode.

In one embodiment, the cap sense body 202 uses capacitive sense technology to sense when the user is holding the intelligent light source. When the cap sense body 202 is touched by the user, the OLED display 301 turns on and displays the last screen that was displayed before it was turned off and enables the cap sense interface button 203 which controls the OLED screen display. In one embodiment, the soft-switch 207 turns the intelligent light source on to the last setting and enables the cap sense interface buttons 203. When the intelligent light source is on, a quick press of the soft-switch 207 disables/enables the cap sense interface buttons 203, while a press and hold of the soft-switch 207 turns the intelligent light source off. In one embodiment, while the cap sense interface buttons 203 are enabled, the user may use these buttons to toggle through the different screens on the OLED display 301, toggle between beam light 205, flood light 206, and lantern light 101 modes, focus the light, and adjust light intensity. In one embodiment, if the user is holding the intelligent light source and has the beam light 205 and or flood light 206 on and then stops touching the cap sense body 202, the beam light 205 and or flood light 206 will fade off while the lantern light 101 fades in simultaneously.

The infrared transmitter/receiver 303 detects when the intelligent light source is placed on a surface head down. When the infrared transmitter/receiver 303 senses this, the lantern light 101 will fade in. In one embodiment, the wireless control 208 may implement Wi-Fi or Bluetooth ZigBee/Z Wave technology or any other wireless transmitter receiver combination to interface the intelligent light source with an external device so that the user may control the light intensity, focus, and or mode indirectly. The PIR motion sensor 307 detects if the user is present or not. If the PIR motion sensor 307 detects that the user is not present for a specified amount of time, the intelligent light source will be turned off in order to conserve battery life. When a specified capacity level of the battery 306 is detected by the intelligent battery metering circuit 302, the auditory/physical feedback alarm 309 provides an auditory and or physical queue such as a beep, sequence of beeps, or vibration in order to alert the user that the battery 306 has reached the specified capacity level.

The lithium-polymer battery with charger circuit 306 is rechargeable and is used to power the LEDs, the OLED display 301, and the microcontroller 305. In one embodiment, the intelligent battery metering circuit 302 and OLED display 301 uses circuitry to monitor and display information about the life of the battery 306.

In one embodiment, the 1D, 2D, 3D accelerometer 304 detects user movements or gestures, and detects the position and orientation of the intelligent light source to control the light intensity, focus, and mode. Examples of commands dictated by movements and gestures may include, but are not limited to the following:

1. "Casting" or throwing motion to quickly switch to 100% beam light 205 or back to lantern light 101.
2. Vertical tap to switch to lantern light 101 or switch back to beam light 205.

3. Press and hold a cap sense interface button 203 and change the angle of the intelligent light source to the ground to control the digital focus 201.

The data processor 305 processes inputs from the cap sense body 202, cap sense interface buttons 203, infrared transmitter/receiver 303, wireless control 208, PIR motion sensor 307, and accelerometer 304 and controls the auditory/physical feedback alarm 309, the LEDs 204 and OLED display 301 accordingly. The data processor 305 is also programmed to learn user preferences, such as the light intensity based on the amount of ambient light that is detected.

In one embodiment the intelligent light source has a head 102 and body 103 used to house all the electronics inside the product. In one embodiment there could be a connector (e.g., a USB Male A connector) used to plug in a USB cable to the intelligent light source. In one embodiment this connector outputs 5 volts DC. In one embodiment the connector could be a mini USB or round power plug used to connect 18 volts DC to 5 volts DC to charge the battery (e.g., lithium battery or equivalent chemical storage).

The substrate 300 (e.g., a printed circuit board, or equivalent) is used to mount electronic components. The one or more batteries 306 in one embodiment can be one or more 3.7 volt lithium polymer batteries (but in alternative embodiments the batteries can be any type of battery). The battery and charger circuit 306 can regulate the incoming voltage (e.g., 110 V, 18V, 5V, or other voltage) to charge the one or more batteries (e.g., one or more lithium batteries, or equivalent batteries).

In one embodiment the current detection circuit 114 includes a small precision resistor, one embodiment uses a current sense resistor in the resistance range of 0.02-0.1 Ohm. By measuring the voltage across this resistor (both positive and negative), one embodiment of the invention can precisely determine the actual amount of current that flows in and out of the battery (e.g., such as a lithium battery). The data processor 305 in one embodiment has analog to digital converters built-in to detect the voltage across the current detection circuit. In one embodiment the data processor 305 also has digital input and output ports (not shown) to control the display graphics and buttons for user input.

In one embodiment, the one or more cap sense interface buttons 203 can be push buttons or capacitive sense touch buttons. In one embodiment the cap sense interface buttons 203 can be used to toggle the views and turn on and off the intelligent light source. In one embodiment, the display 301 could be an OLED display, a LED display, or a LCD display used to show one or more parameters about the status of the light source or the light source batteries.

Figure 5:
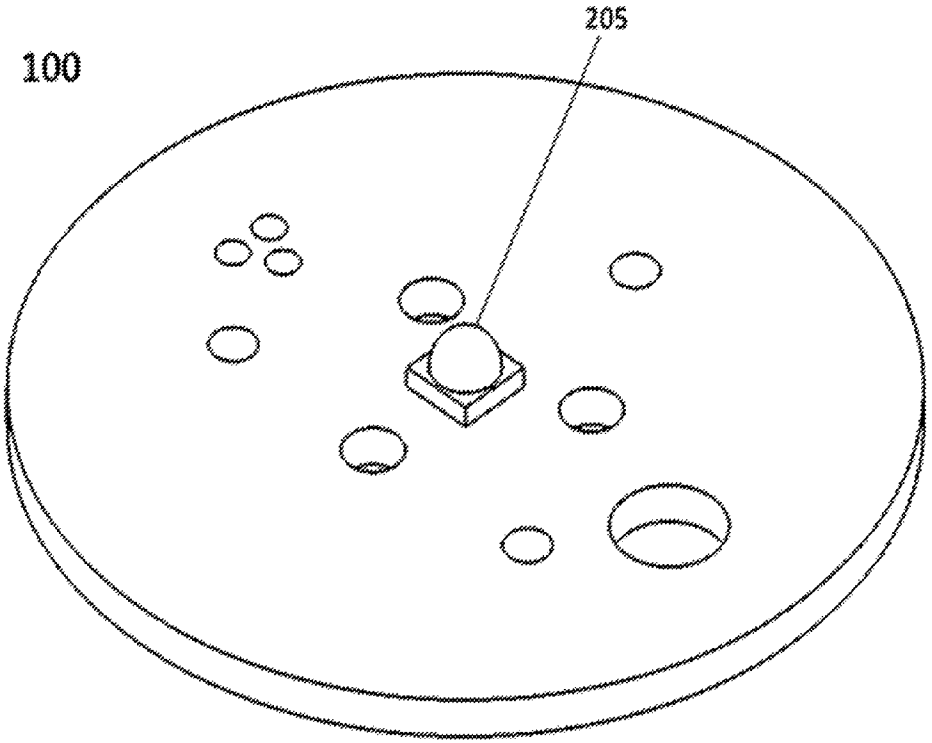
FIG. 5 illustrates a top view of one substrate in an intelligent light source, in accordance with one embodiment of the invention.

FIG. 5 illustrates a top isometric view of a substrate of an intelligent light source, in accordance with one embodiment of the invention. FIG. 5 shows a beam light 205 on a first substrate 100. In another embodiment, there would additionally be one or more flood lights 206 on the first substrate 100.

Figure 6:
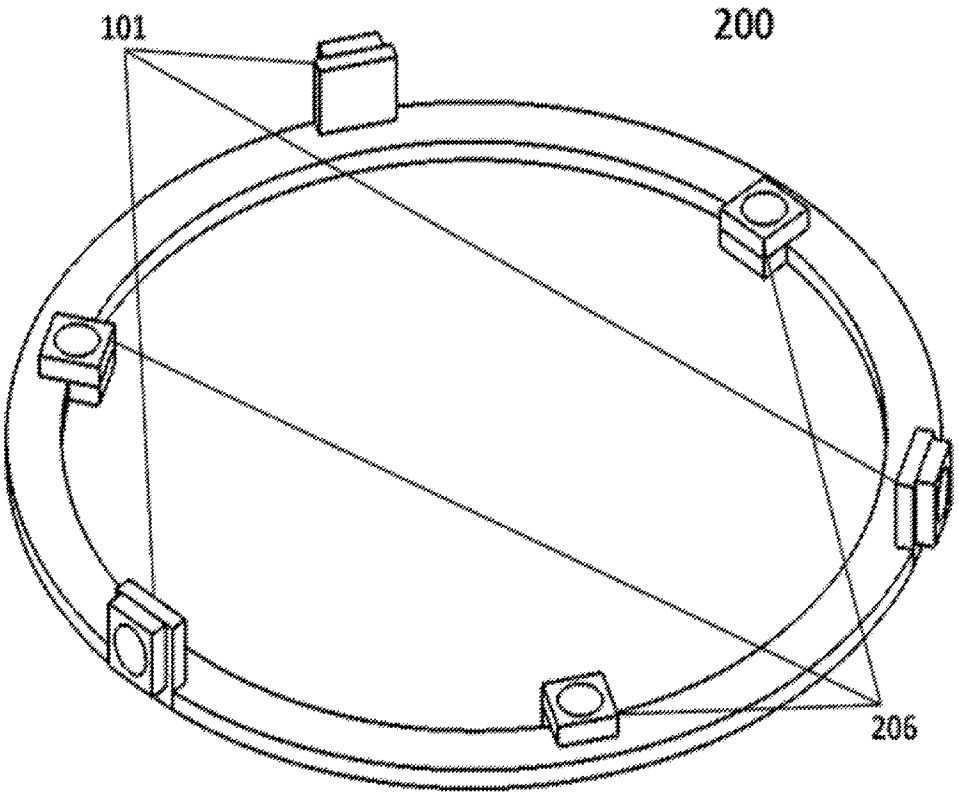
FIG. 6 illustrates a top view of an optional second substrate in an intelligent light source, in accordance with one embodiment of the invention.

FIG. 6 illustrates a top isometric view of an optional second substrate of an intelligent light source, in accordance with one embodiment of the invention. FIG. 6 shows three lantern lights 101 and three flood lights 206 on an optional second substrate 200. Other embodiments would have more or less lantern lights 101 and flood lights 206.

Figure 7:
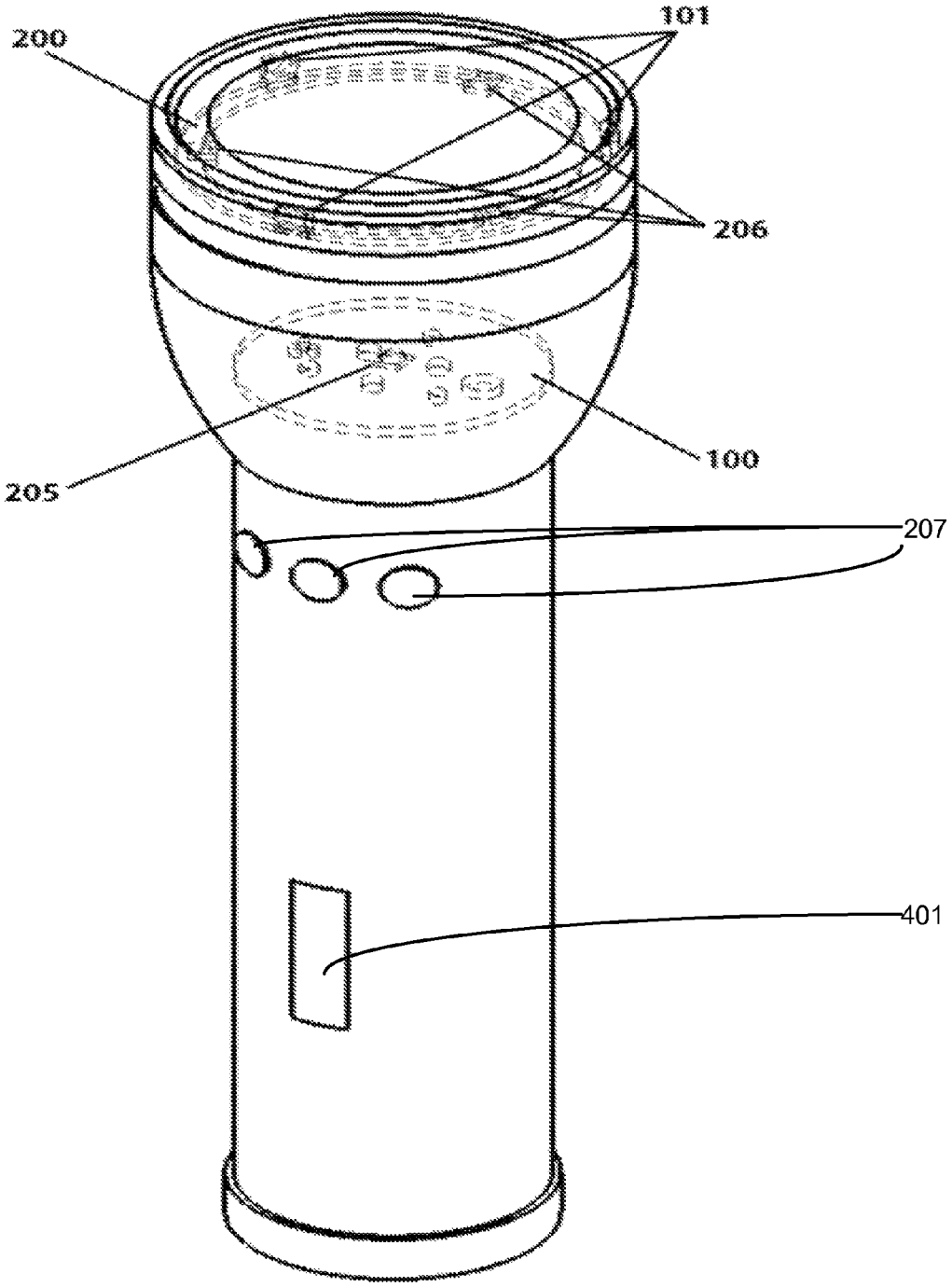
FIG. 7 illustrates a side view of two substrates in an intelligent light source, in accordance with one embodiment of the invention.

FIG. 7 illustrates a side view of two substrates in an intelligent light source, in accordance with one embodiment of the invention. FIG. 7 shows a beam light 205 on a first substrate 100, and three lantern lights 101 and three flood lights 206 on an optional second substrate 200. Three soft switches 207 and a screen 401 are also shown.

Figure 8:
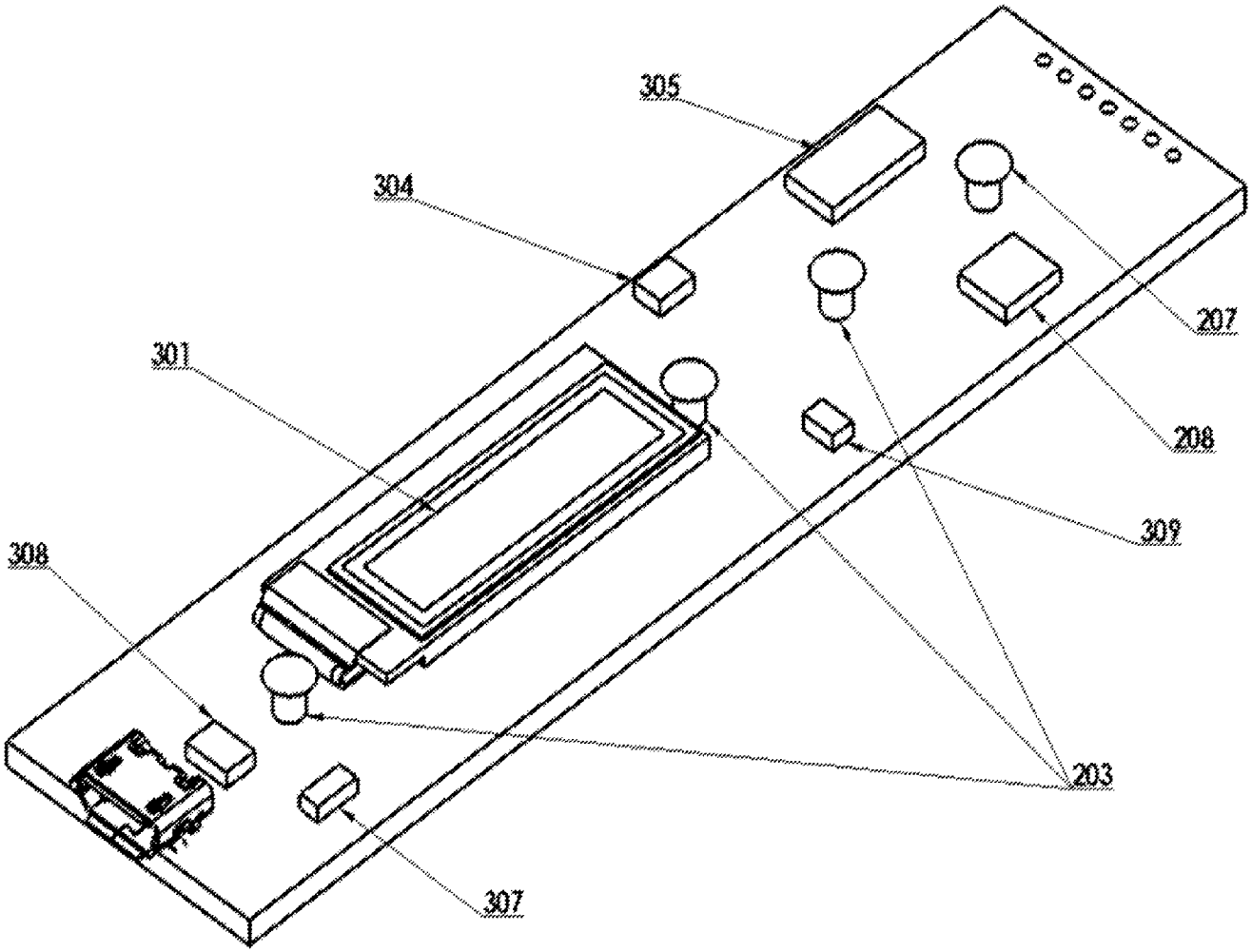
FIG. 8 illustrates an isometric top view of an optional third substrate of an intelligent light source, in accordance with one embodiment of the invention.

FIG. 8 illustrates an isometric top view of an optional third substrate of an intelligent light source, in accordance with one embodiment of the invention. FIG. 8 shows one or more cap sense interface buttons 203, a soft-switch 207, a wireless control 208, an optional third substrate 300, a display 301, an intelligent battery meter 302, an infrared transmitter/receiver 303, a 1D, 2D, 3D accelerometer 304, a data processor 305, a battery with charger circuit 306 (e.g., a lithium polymer battery or equivalent), a passive infrared (PIR) motion sensor 307, an ambient light sensor 308, an auditory/physical feedback alarm 309. In this embodiment there is a display 301. This is only one illustrative example of such a substrate, because other embodiments of this substrate could be implemented without certain components.

Figure 9:
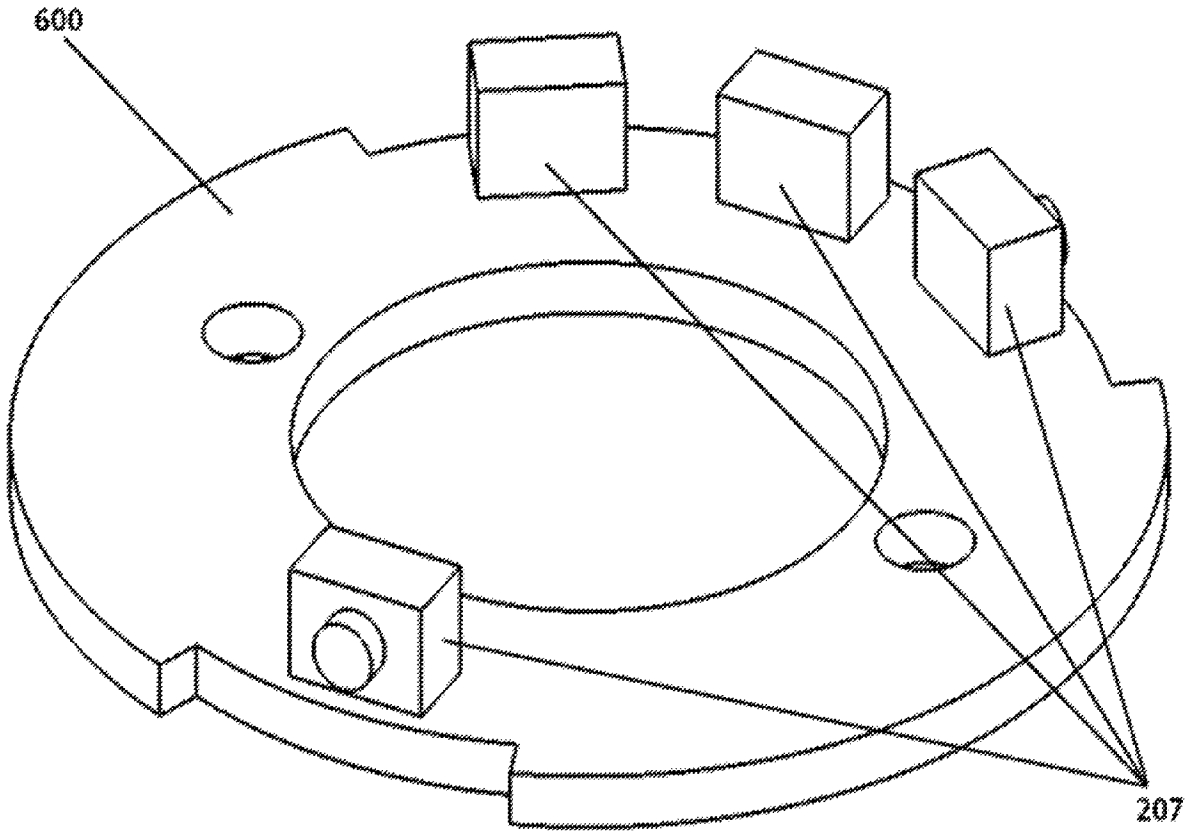
FIG. 9 illustrates a substrate with soft switches, in accordance with one embodiment of the invention.

FIG. 9 illustrates a substrate with one or more soft-switches, in accordance with one embodiment of the invention. FIG. 9 shows a printed circuit board 600 with four soft-switches 207. In another embodiment there would be another substrate material used for making the board 600.

Figure 10:
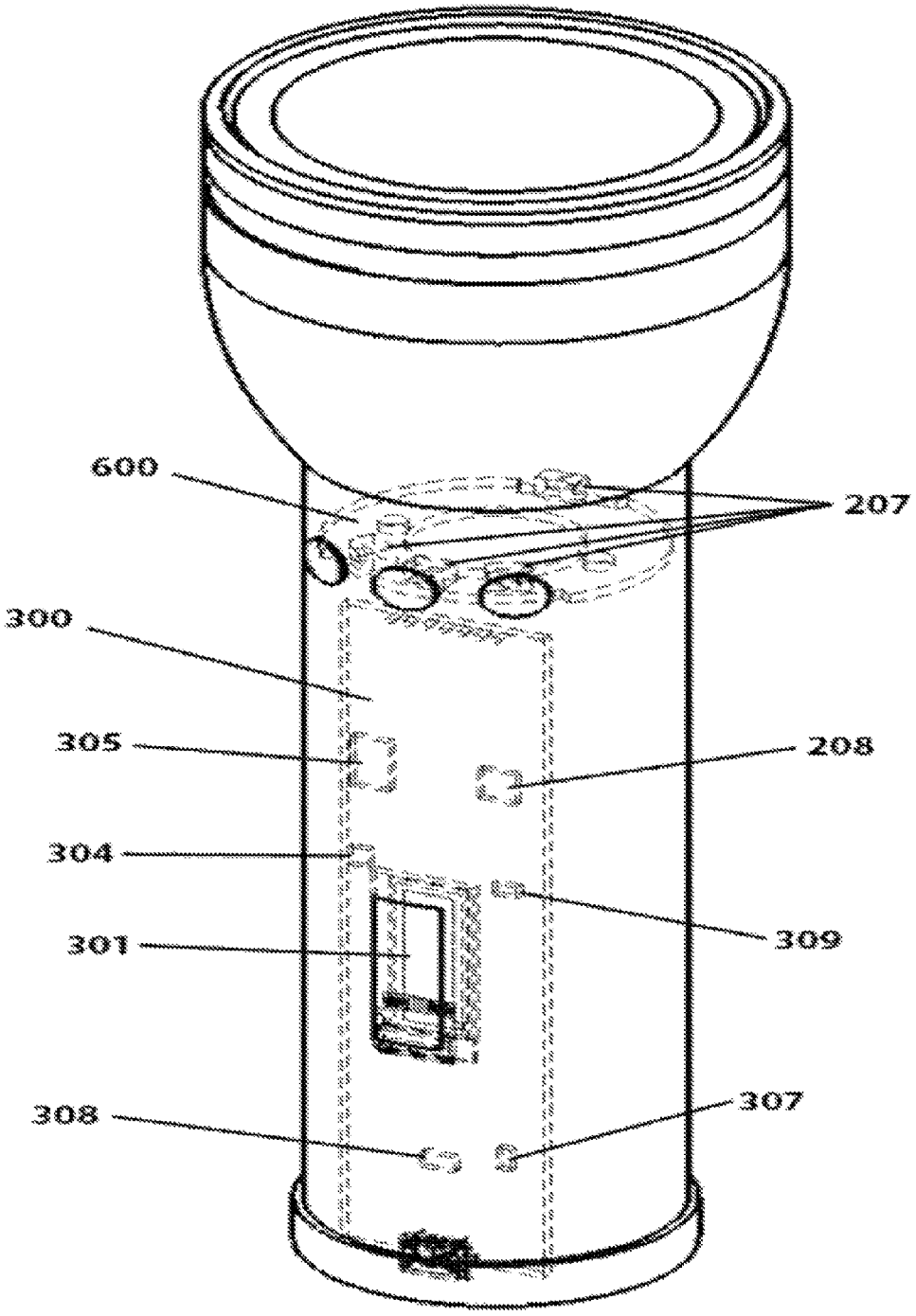
FIG. 10 illustrates a side view of two substrates in an intelligent light source, in accordance with one embodiment of the invention.

FIG. 10 illustrates a side view of an intelligent light source, in accordance with one embodiment of the invention. FIG. 10 shows three soft-switches 207, a wireless control 208, an optional third substrate 300, a display 301, an infrared transmitter/receiver 303, a 1D, 2D, 3D accelerometer 304, a data processor 305, a passive infrared (PIR) motion sensor 307, an ambient light sensor 308, an auditory/physical feedback alarm 309. In this embodiment there is a display 301. This is only one illustrative example of such a substrate, because other embodiments of this substrate could be implemented without certain components, or additional components.

Figure 11:
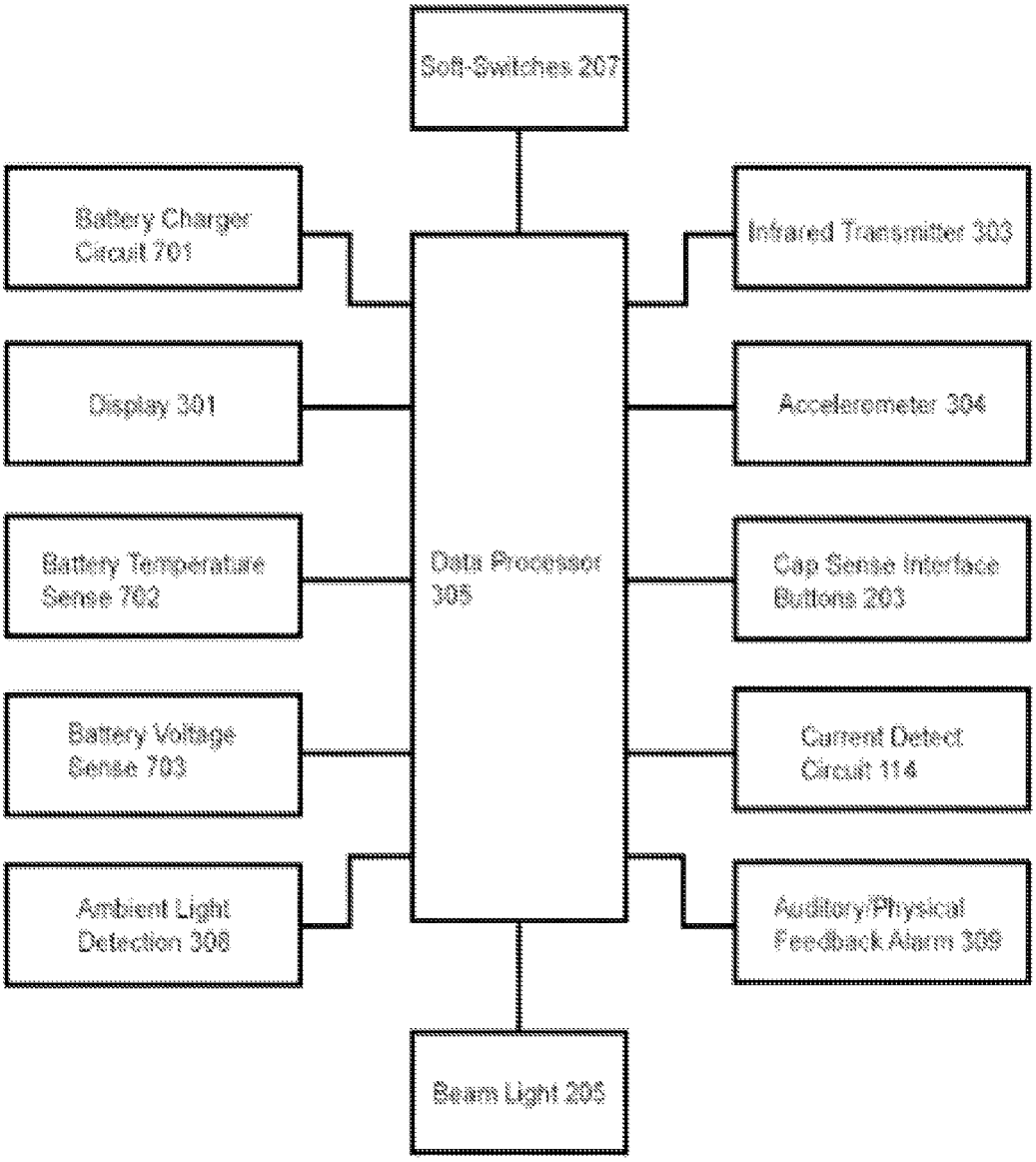
FIG. 11 illustrates the components of a three substrate implementation, in accordance with one embodiment of the invention.

FIG. 11 illustrates the components of a three substrate implementation, in accordance with one embodiment of the invention. FIG. 11 shows a data processor 305 (e.g., microcontroller, microprocessor, CPU, programmable system on a chip, or equivalent), which is electrically coupled to one or more soft-switches 207, a battery charger circuit 701, a display 301, a battery temperature sense module 702, a battery voltage sense module 703, an ambient light detection module 308, one or more beam light(s) 205, an auditory/physical feedback alarm 309, a current sense detection circuit 114, one or more cap sense interface button(s) 203, an accelerometer (e.g., a 1D, 2D, 3D accelerometer), and an infrared transmitter/receiver 303. This is only one illustrative example, because other embodiments could be implemented without certain components, or additional components.

Figure 12:
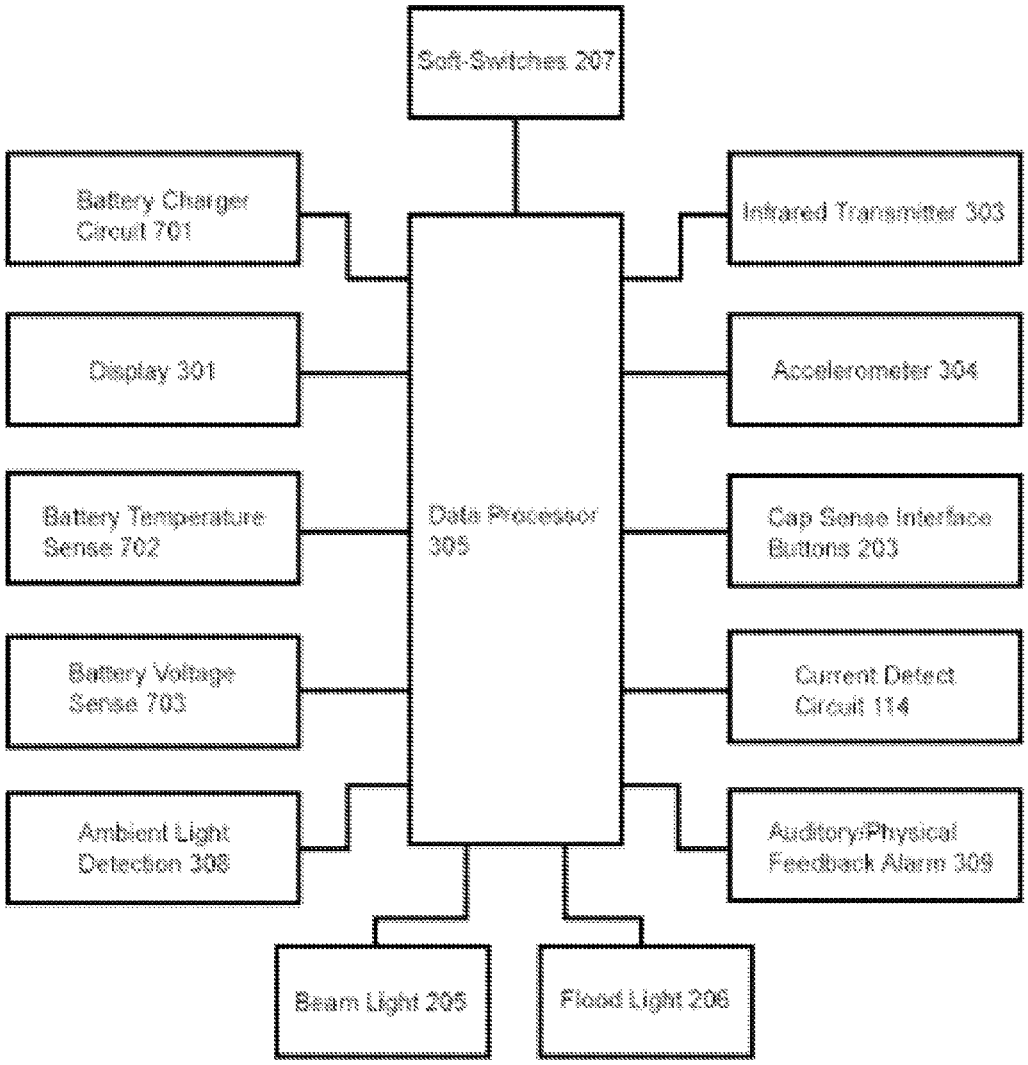
FIG. 12 illustrates the components of a two substrate implementation, in accordance with one embodiment of the invention.

FIG. 12 illustrates the components of a two substrate implementation, in accordance with one embodiment of the invention. FIG. 12 shows a data processor 305 (e.g., microcontroller, microprocessor, CPU, programmable system on a chip, or equivalent), which is electrically coupled to one or more soft-switches 207, a battery charger circuit 701, a display 301, a battery temperature sense module 702, a battery voltage sense module 703, an ambient light detection module 308, one or more beam light(s) 205, one or more flood light(s) 206, an auditory/physical feedback alarm 309, a current sense detection circuit 114, one or more cap sense interface button(s) 203, an accelerometer (e.g., a 1D, 2D, 3D accelerometer), and an infrared transmitter/receiver 303. This is only one illustrative example, because other embodiments could be implemented without certain components, or additional components.

Figure 13:
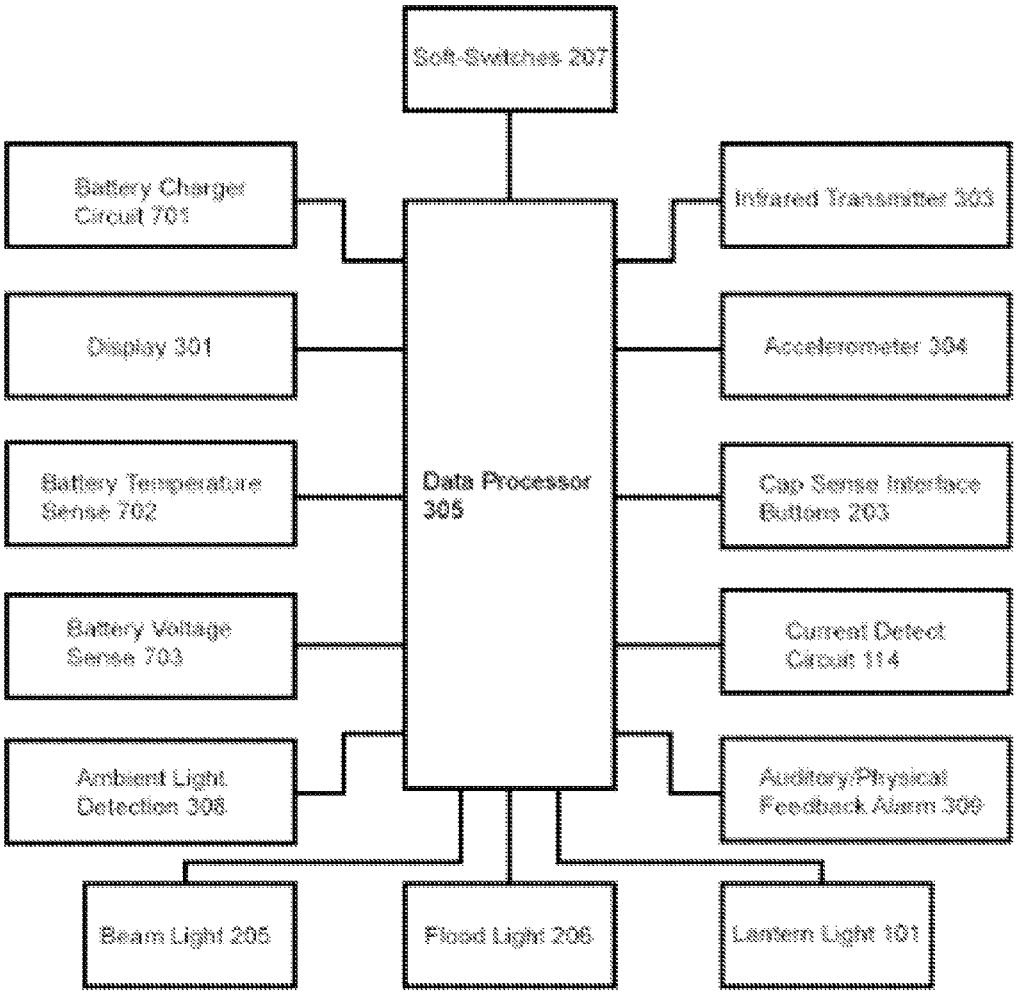
FIG. 13 illustrates the components of a single substrate implementation, in accordance with one embodiment of the invention.

FIG. 13 illustrates the components of a single substrate implementation, in accordance with one embodiment of the invention. FIG. 13 shows a data processor 305 (e.g., microcontroller, microprocessor, CPU, programmable system on a chip, or equivalent), which is electrically coupled to one or more soft-switches 207, a battery charger circuit 701, a display 301, a battery temperature sense module 702, a battery voltage sense module 703, an ambient light detection module 308, one or more lantern light(s) 101, one or more beam light(s) 205, one or more flood light(s) 206, an auditory/physical feedback alarm 309, a current sense detection circuit 114, one or more cap sense interface button(s) 203, an accelerometer (e.g., a 1D, 2D, 3D accelerometer), and an infrared transmitter/receiver 303. This is only one illustrative example, because other embodiments could be implemented without certain components, or additional components.

Figure 14:
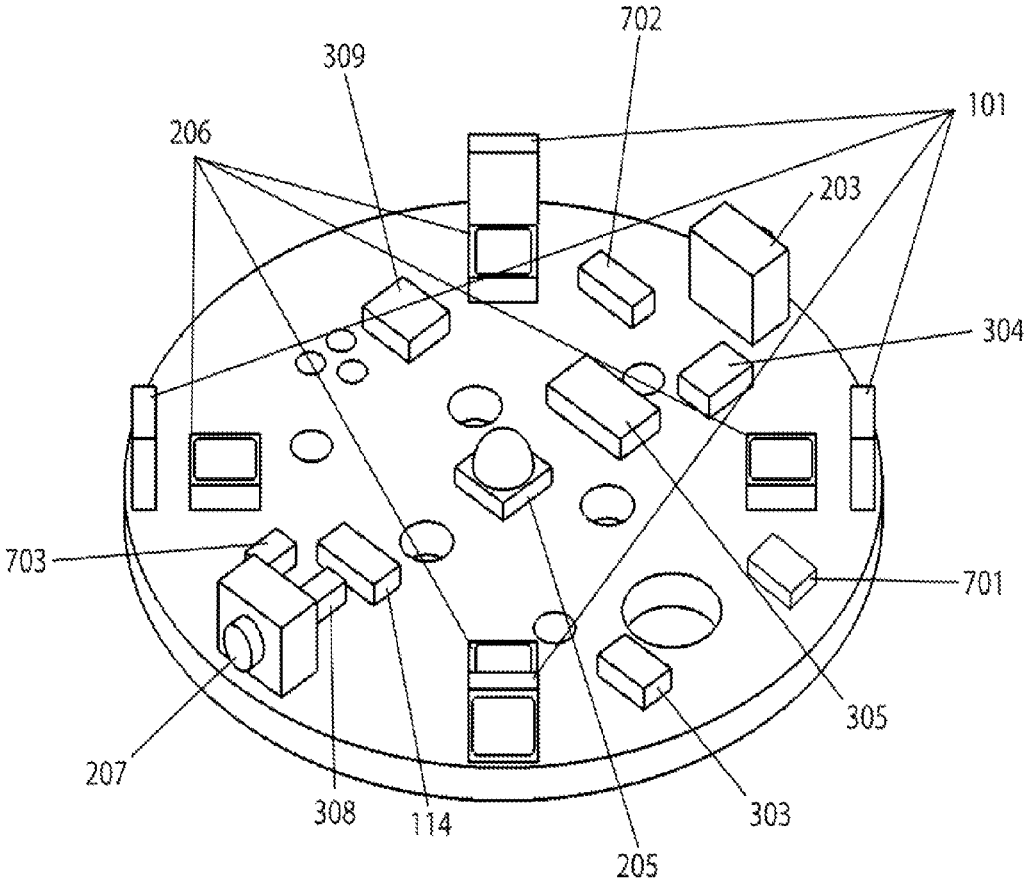
FIG. 14 illustrates a single substrate with components, in accordance with one embodiment of the invention.

FIG. 14 illustrates a single substrate with components, in accordance with one embodiment of the invention. FIG. 14 shows a data processor 305 (e.g., microcontroller, microprocessor, CPU, programmable system on a chip, or equivalent), which is electrically coupled to one or more soft-switches 207, a battery charger circuit 701, a display 301, a battery temperature sense module 702, a battery voltage sense module 703, an ambient light detection module 308, one or more lantern light(s) 101, one or more beam light(s) 205, one or more flood light(s) 206, an auditory/physical feedback alarm 309, a current sense detection circuit 114, one or more cap sense interface button(s) 203, an accelerometer (e.g., a 1D, 2D, 3D accelerometer), and an infrared transmitter/receiver 303.

In one embodiment, the electricity is carried by one wire or trace, and the electrical ground is carried by two wires or traces. In another embodiment, simply two wires or trace (one wire or trace for the electricity and one wire or trace for ground) are used. In alternative embodiments more electrical wires or traces can be used. In one embodiment, there is a controller module that has an on-off switch and a charger port for charging a plurality of internal batteries.

The energy source in various embodiments can be one or more batteries, a photovoltaic electrical module, an electrical recharger, or some other equivalent electrical energy source with a capacity for supplying an appropriate amount of voltage and current. One embodiment of the invention uses one or more electrochemical batteries (e.g., lithium ion batteries, typically rated at 3.6 volts under normal conditions and 4.2 volts when fully charged, or other equivalent electrochemical batteries, either single charge or rechargeable, or other equivalent power sources). Most of the electrical power provided by such batteries will be used for supply power to operate electronics, and to operate the display and data processor.

Figure 15:
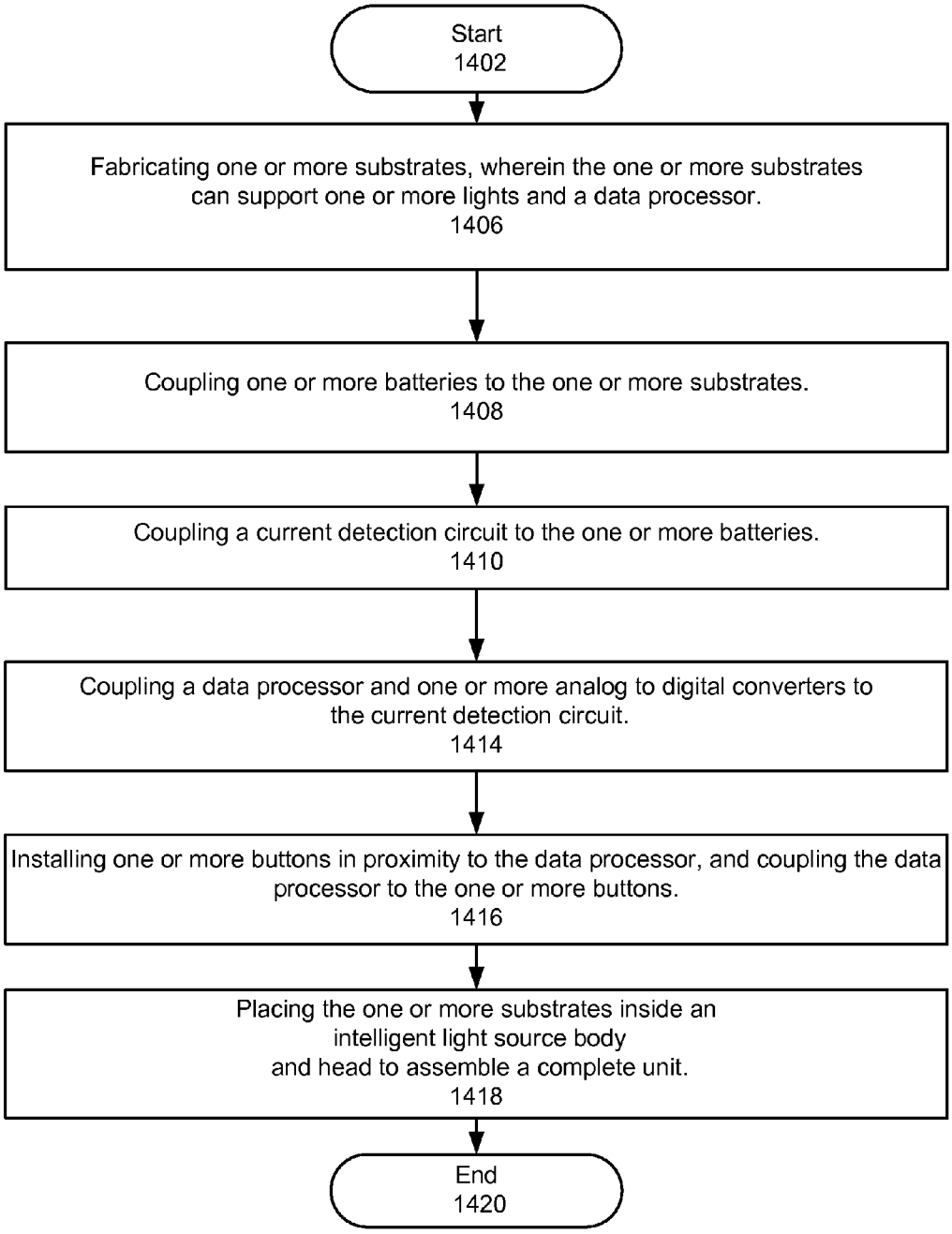
FIG. 15 illustrates a flowchart to make an intelligent light source, in accordance with one embodiment of the invention.

FIG. 15 illustrates a flowchart to make intelligent light source, in accordance with one embodiment of the invention. The method starts in operation 1402. Operation 1406 is next and includes fabricating one or more substrates, wherein the one or more substrates can support one or more lights and a data processor. Alternative embodiments can use only one or two or three substrates. Operation 1408 is next and includes coupling one or more batteries to the one or more substrates. Operation 1410 is next and includes coupling a current detection circuit to the one or more batteries. Operation 1414 is next and includes coupling the data processor and one or more analog to digital converters to the current detection circuit. In one embodiment, the data processor can calculate estimated remaining battery life, current drain on the one or more batteries, clock time, and/or other equivalent parameters as previously described. Operation 1416 is next and includes installing one or more buttons in proximity to the data processor, and coupling the data processor to the one or more buttons. Operation 1418 is next and includes placing the one or more substrates inside an intelligent light source body and head to assemble a complete unit. The method ends in operation 1420.

Figure 16:
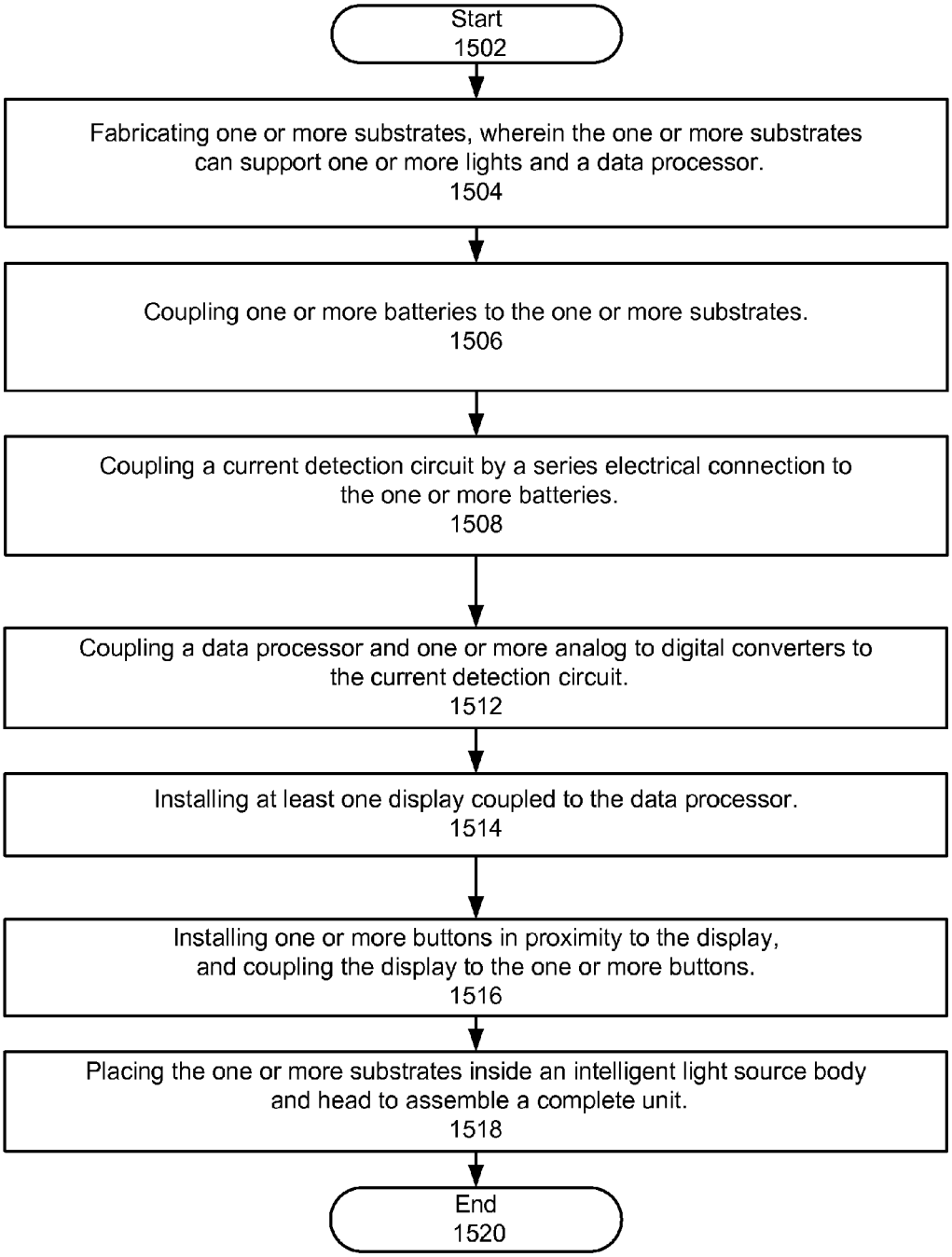
FIG. 16 illustrates a flowchart to make an intelligent light source with display, in accordance with one embodiment of the invention.

FIG. 16 illustrates a flowchart to make intelligent light source, in accordance with another embodiment of the invention. The method starts in operation 1502. Operation 1504 is next and includes fabricating one or more substrates, wherein the one or more substrates can support one or more lights and a data processor. Alternative embodiments can use only one or two or three substrates. Operation 1506 is next and includes coupling one or more batteries to the one or more substrates. Operation 1508 is next and includes coupling a current detection circuit by a series electrical connection to the one or more batteries. Operation 1512 is next and includes coupling a data processor and one or more analog to digital converters to the current detection circuit. Operation 1514 is next and includes installing at least one display coupled to the data processor. The source of electricity for the at least one display would be the one or more batteries in one embodiment of the invention. Operation 1516 is next and includes installing one or more buttons in proximity to the display, and coupling the display to the one or more buttons. Operation 1518 is next and includes placing the one or more substrates inside an intelligent light source body and head to assemble a complete unit. The method ends in operation 1520.

Other embodiments of the invention are possible. For example, the intelligent light source could be composed of several laminations of various materials for different applications. Another embodiment of the invention could provide multiple adjustable connectors to accommodate different sizes and lengths of electronics, energy sources, and cords.

The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. A method to make an intelligent light source, comprising:

fabricating one or more substrates, wherein the one or more substrates can support one or more lights and a data processor;

coupling one or more lights capable of supporting a digital focus to adjust between flood and beam states, to the one or more substrates;

coupling one or more batteries to the one or more substrates;

coupling a current detection circuit on the one or more substrates to the one or more batteries;

coupling a data processor and one or more analog to digital converters to the current detection circuit;

coupling an accelerometer to the data processor to detect one or more accelerations of movement of the one or more substrates and adjust between the flood and beam states of the one or more lights;

installing one or more buttons in proximity to the data processor, and coupling the data processor to the one or more buttons; and placing the one or more substrates inside an intelligent light source flashlight body and head to assemble a complete flashlight unit.

2. The method of claim 1, further including installing at least one display coupled to the data processor and installing one or more buttons, and coupling the display to the one or more buttons; and wherein coupling a current detection circuit to the one or more batteries includes making an electrical series connection between the current detection circuit and the one or more batteries.

3. The method of claim 1, wherein coupling a data processor and one or more analog to digital converters to the current detection circuit includes a data processor comprising the one or more analog to digital converters.

4. The method of claim 1, wherein installing at least one display includes installing a LCD display.

5. The method of claim 1, wherein installing at least one display includes installing an LED display.

6. The method of claim 1, wherein installing at least one display includes installing an OLED display.

7. The method of claim 1, further comprising:

coupling an infrared transmitter and receiver to the data processor.

8. The method of claim 1, wherein coupling an accelerometer includes coupling a 1D, 2D, or 3D accelerometer to the data processor.

9. The method of claim 1, wherein installing one or more buttons includes installing one or more capacitive sense touch buttons.

10. A method to make an intelligent light source, comprising:

fabricating one or more substrates, wherein the one or more substrates can support one or more lights and a data processor;

coupling one or more lights capable of supporting a digital focus to adjust between flood and beam states, to the one or more substrates;

coupling one or more batteries to the one or more substrates;

coupling a current detection circuit on the one or more substrates to the one or more batteries;

coupling a data processor and one or more analog to digital converters to the current detection circuit;

coupling an accelerometer to the data processor to detect one or more accelerations of movement of the one or more substrates and adjust between the flood and beam states of the one or more lights;

installing at least one display coupled to the data processor;

installing one or more buttons in proximity to the display, and coupling the display to the one or more buttons; and placing the one or more substrates inside an intelligent light source flashlight body and head to assemble a complete flashlight unit.

11. An intelligent light source, comprising:

one or more substrates that can support one or more lights and a data processor;

one or more lights capable of supporting a digital focus to adjust between flood and beam states, coupled to the one or more substrates;

one or more batteries, wherein the one or more batteries are coupled to the one or more substrates;

a current detection circuit, wherein the current detection circuit is coupled to the one or more batteries;

a data processor and one or more analog to digital converters coupled to the current detection circuit;

an accelerometer coupled to the data processor to detect one or more accelerations of movement of the one or more substrates and adjust between the flood and beam states of the one or more lights;

at least one display coupled to the data processor; and one or more buttons in proximity to the data processor, wherein the one or more buttons are coupled to the display and data processor, wherein the one or more buttons, the data processor, the at least one display, the one or more batteries, and the current detection circuit are coupled to an intelligent light source flashlight body and head to comprise a flashlight.

12. The intelligent light source of claim 11, wherein the current detection circuit is in an electrical series connection to the one or more batteries.

13. The intelligent light source of claim 11, wherein the data processor is a microprocessor or micro-controller that includes the one or more analog to digital converters.

14. The intelligent light source of claim 11, wherein the at least one display includes a LCD display.

15. The intelligent light source of claim 11, wherein the at least one display includes an LED display.

16. The intelligent light source of claim 11, wherein the at least one display includes an OLED display.

17. The intelligent light source of claim 11, wherein the accelerometer is 1D, 2D, or 3D accelerometer to detect changes in motion or position that is coupled to the data processor.

18. The intelligent light source of claim 11, further comprising:

an infrared transmitter and receiver that is coupled to the data processor.

19. The intelligent light source of claim 11, wherein the one or more buttons include one or more capacitive sense touch buttons.

20. The intelligent light source of claim 11, wherein the at least one display includes a display to display at least one parameter selected from the group of parameters consisting of: charge remaining, current out, current in, watts out, watts in, time remaining, time to recharge the one or more batteries, battery temperature, battery voltage, the age of the battery, degradation of the battery, and clock time.

* * * * *